United States Patent [19]

Kanemaru et al.

[11] 4,084,399

[45] Apr. 18, 1978

[54] GUT FOR RACKET

[75] Inventors: Toyonosuke Kanemaru, Tokyo; Yukuo Hisatomi; Takafumi Nishimoto, both of Yokohama, all of Japan

[73] Assignee: Nippon Carbon Kabushiki Kaisha, Tokyo, Japan

[21] Appl. No.: 716,685

[22] Filed: Aug. 23, 1976

[30] Foreign Application Priority Data

Mar. 31, 1976 Japan ..... 51-34316

[51] Int. Cl.[2] ..... D02G 3/04; D02G 3/36; D02G 3/44

[52] U.S. Cl. ..... 57/140 C; 57/140 BY; 57/153; 428/367; 428/389

[58] Field of Search ..... 57/139, 149, 140 R, 57/140 C, 140 BY, 153; 428/367, 368, 375, 378, 388, 389, 392, 394

[56] References Cited

U.S. PATENT DOCUMENTS

| | | | |
|---|---|---|---|
| 2,930,105 | 3/1960 | Budd | 57/153 X |
| 3,565,127 | 2/1971 | Nicely et al. | 57/140 BY X |
| 3,574,665 | 4/1971 | Basche | 428/367 X |
| 3,702,054 | 11/1972 | Araki et al. | 57/140 R X |
| 3,770,488 | 11/1973 | Pepper et al. | 57/153 X |
| 3,841,079 | 10/1974 | Ram et al. | 57/140 R |

*Primary Examiner*—Richard C. Queisser
*Assistant Examiner*—Charles Gorenstein
*Attorney, Agent, or Firm*—Haseltine, Lake & Waters

[57] ABSTRACT

A gut is provided for a sports racket such as a tennis racket. The gut is made with carbon fibers. The gut may be made solely of carbon fibers or there may be a combination of carbon fibers and organic and/or inorganic fibers. A coating may be provided for the resultant product which may be a synthetic resin or metallic. The carbon fiber is above 150 kg/mm$^2$ in tensile strength.

20 Claims, 5 Drawing Figures

GUT FOR RACKET

FIELD OF THE INVENTION

This invention relates to guts for rackets and, more particularly, to guts adapted for being stretched in the frame of a racket suitable for such sports as tennis, badminton, squash or the like.

BACKGROUND OF THE INVENTION

For guts adapted for being incorporated in rackets used for sports, there has been used animal strings such as sheep guts, whale string or the like which is properly twisted and is then subjected to surface treatment.

This animal string gut is good in tensile modulus but is not resistant to moisture and becomes sticky at its surface and easily stretches under wet conditions and, on the other hand, contracts when it becomes dry. If the gut is stretched in a racket frame under extreme wet conditions, it is stretched into its most extended state. Thus, it often happens that the same is broken when dried.

Additionally, the available amount thereof is limited from a standpoint of resources, and difficulty with respect to supply sources is involved. Further, such gut is deficient in that it is comparatively small in breaking strength and weak in durability, and in that it is difficult to make products constant in modulus property on account of the varying character of the raw material. Moreover, the gut varies in its size and shape so that, when a tensile load is applied thereto, the force is likely to concentrate at its smaller diameter portions and breakage occurs at that portion. Additionally, the gut is high in price. (It will be noted relative to the above that the modulus is a value expressed as $W/\Delta 1/1$ wherein the tension load is W and an elongation of the gut at that time is $\Delta 1/1 \times 100$ (%).)

Recently, a gut for a racket made of synthetic fiber has been developed. This kind of gut can overcome various deficiencies of animal string gut with respect to moisture resisting properties, inequalities, availability, price and so forth. However, it is lower in tensile modulus and is defective with respect to changing of characteristic of elongation in response to tensile load, as compared with animal string, so that proper adjustment thereof on applying the same to a racket frame cannot be easily obtained. Moreover, it is inferior to animal string gut on the basis of ball batting properties and bouncing properties.

More specifically, the tensile modulus of the different animal string (that is, of sheep gut and of whale string) extend nearly linearly in almost direct proportion to the tensile load as will be shown hereinafter. However, in the case of synthetic fiber — (for instance, Nylon fiber), it fluctuates and is not linear. Also, it is lower in tensile modulus than the typical sheep gut, and thus is not suitable for use in a racket.

There has been also proposed a gut for tennis such that the surface of a synthetic resin filament is made rough and there is applied thereto a treating agent comprising paste having an adhesion property and a small amount of filler serving to give a frictional characteristic. Thereby, the ball batting property is improved to have a sufficient ball holding ability. There has also been used a gut for tennis and badminton such that a synthetic fiber multifilament is twisted and the surfaces of the monofilaments thereof are fused together under stretched condition. None of these guts overcome sufficiently the aforementioned defects inherent in synthetic fibers. They are low in tensile modulus and are inferior to animal string.

For avoiding the defects in synthetic fibers, an improvement has been tried whereby a metallic wire is embodied in a synthetic fiber. The metallic wire is small in specific rigidity (Young's modulus/specific gravity). If the same is combined to such an extent that an appreciable result is obtained, the resultant gut is large in weight and, at the same time, lacks flexibility. Accordingly, for preventing any increase in weight of the associated racket, the gut must be made smaller in diameter or the manner of stretching the gut in a racket frame must be changed.

SUMMARY OF THE INVENTION

It is an object of the invention to provide a gut for a racket having the good points inherent in animal string gut and the good points inherent to synthetic fiber gut.

The present invention is characterized in that a gut is composed at least partly of carbon fibers.

Embodiments of this invention include the following:

1. a gut composed of a combination of carbon fibers and organic fibers (synthetic fibers such as polyamide, polyester, aramide fibers or the like);
2. a gut comprising a combination of the foregoing carbon fibers, organic fibers and inorganic fibers;
3. a gut comprising fibers as in any of the foregoing and a coating material of aluminum, copper, tin or an alloy chiefly composed of any of those metals; and
4. a gut comprising the fibers described in any of the foregoing and a coating of synthetic resin.

For combining various kinds of fibers as mentioned above, a process is provided such that respective fibers are doubled together, or spun together, the chopped fibers thereof are mixed together and spun, or multifilaments of respective fibers are twisted with one another, or multifilaments of respective fibers are knitted or braided together into a cord or string form. As for the carbon fibers, it is preferable to use especially such a multifilament that is high in tensile strength (above 150 $kg/mm^2$), high in Young's modulus (above 14 $t/mm^2$), and 1 – 4% in elongation.

The combination of various kinds of fibers is reinforced with synthetic resin. For this purpose, a process is provided whereby the combination is passed through a molten synthetic resin bath so that the surface thereof may be coated with a resin layer, or the surfaces of respective fibers are coated individually with the synthetic resin layers, or respective fibers individually coated with synthetic resin layers are twisted around fibers which are not coated.

More particularly to achieve the objectives of the invention there is provided a gut for a racket comprising a combination of carbon fibers and organic fibers. Furthermore the gut may be composed of a combination of carbon fibers, organic fibers and inorganic fibers. Still further a coating may be provided in the form of aluminum, copper, tin or alloys thereof.

In accordance with further features of the invention, a synthetic resin may be employed as a coating material. Moreover, the carbon fibers may be in the form of a twisted multifilament and there may be a plurality of carbon fibers monofilaments twisted together therewith. Still further the gut for a racket in accordance with the invention may comprise a synthetic resin According to another embodiment of the invention, the gut may comprise at least a single carbon fiber twisted multifilament twisted around the synthetic fibers which are in the form of at least one single organic fiber monofilament or twisted multifilament which constitutes a core.

According to yet another embodiment of the invention, the gut may comprise a multifilament of string or tape form comprising a plurality of carbon fiber monofilaments twisted around the synthetic fibers which are in the form of at least one single organic fiber monofilament or twisted multifilament which constitutes a core.

According to still another embodiment of the invention, a gut thereof may comprise a plurality of inorganic fiber monofilaments twisted together with said carbon fibers which are in the form of at least a single carbon-fiber twisted multifilament.

In the aforegoing arrangements there may be provided a synthetic resin coating layer thereon or alternatively a metallic coating layer may be provided thereon.

Preferably the carbon fiber of the invention is above 150 kg/mm$^2$ in tensile strength, 14 ton/mm$^2$ in Young's modulus, and 1–4% in elongation.

DETAILED DESCRIPTION

Figure 1:
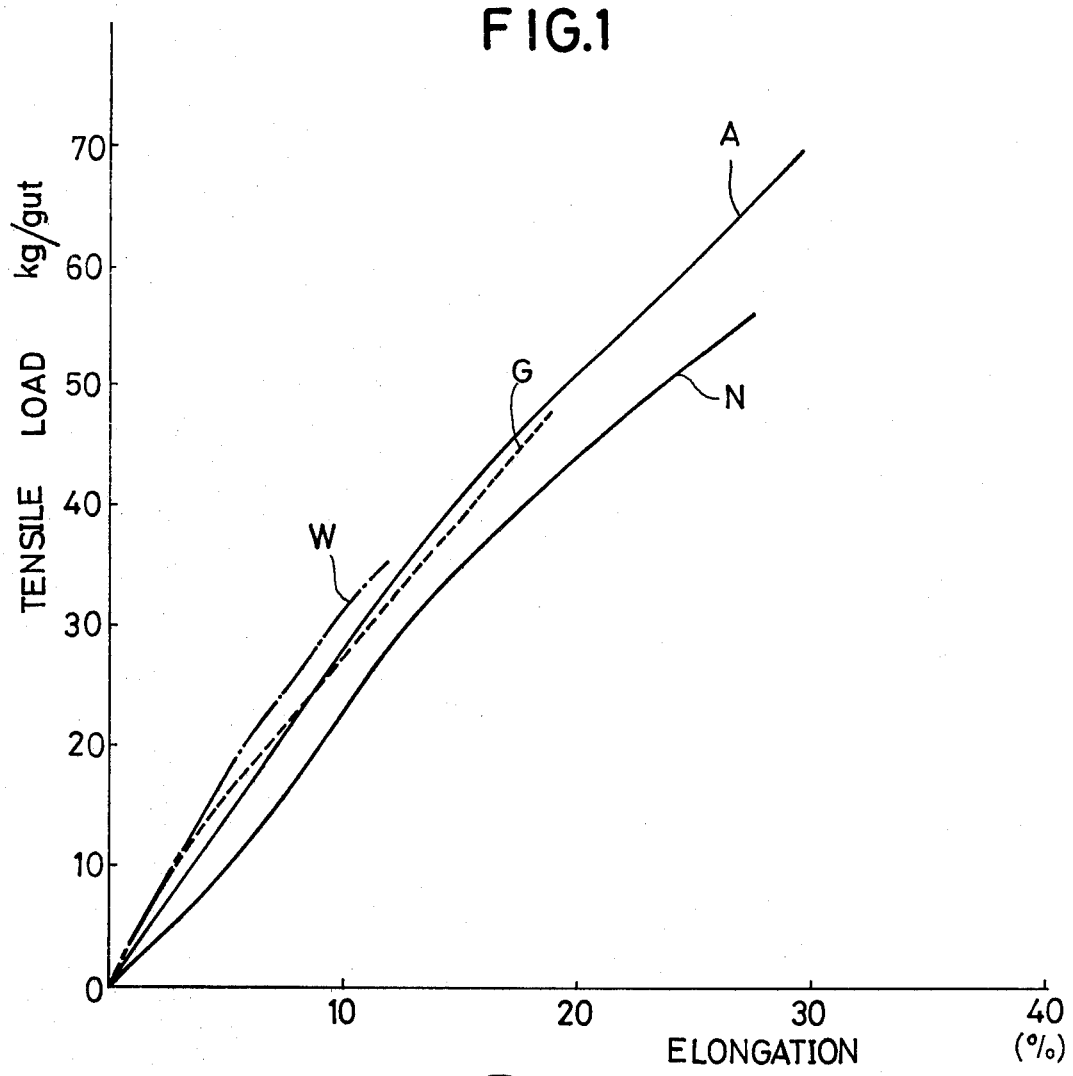
FIG. 1 is a diagram showing the relationship between tensile load and elongation with respect to conventional guts in comparison with the gut of this invention.

The mode of tensile modulus of the different types of animal string are shown by way of example in FIG. 1. Therein is illustrated the curve for sheep gut G and whale string W. These extend nearly linearly in almost direct proportion to the tensile load. In the case of synthetic fiber N (for instance, nylon fiber) it fluctuates and the mode is not linear. Furthermore it is lower in tensile modulus than the typical sheep gut G and thus it is not suitable for use in rackets.

Figure 2:
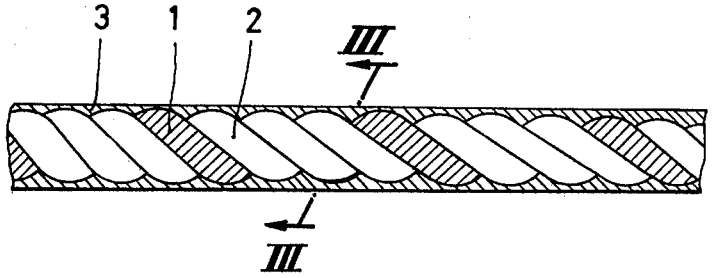
FIG. 2 is an enlarged, sectional, side view of a gut in accordance with one embodiment of this invention.
Figure 3:
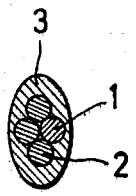
FIG. 3 is a sectional view taken along line III—III in FIG. 2.

FIGS. 2 and 3 show a gut in accordance with one embodiment of this invention. Element 1 is a carbon fiber multifilament (18 t/mm$^2$ in Young's modulus, 300 kg/mm$^2$ in tensile strength and 1.7% in elongation) which is prepared such that 2000 carbon fiber monofilaments, each being 5$\mu$ in diameter, are twisted together in a combination of 200 turns/m. Element 2 is a filament of Nylon 6 No. 1 (0.16 mm in diameter) which is 34 kg/mm$^2$ in tensile strength and 200kg/mm$^2$ in Young's modulus. One of the aforegoing carbon fiber multifilament 1 and three of the aforegoing nylon filaments 2 are twisted together in a combination of 50 turns/m and the resultant intermediate product is coated with a nylon layer 3 by passing the same through a molten Nylon bath.

The gut thus obtained is 1.4 mm. in diameter and various properties thereof have been measured. This product of the invention, which is identified as A, is compared with conventional ones in Table 1 and FIGS. 1 and 5.

TABLE 1

| | Wire density (g./m.) | Gut diameter (mm.) | Breaking strength (kg./gut) | Modulus (kg./unit) |
|---|---|---|---|---|
| Product A | 1.35 | 1.4 | 70 | 270 |
| Whale gut product | 1.65 | 1.25 | 35 | 290 |
| Sheep gut product | 1.54 | 1.4 | 48 | 260 |
| Nylon gut product | 1.69 | 1.45 | 56 | 230 |

Here, each modulus value is an average value obtained from loads of 30 – 40 kg./gut which are those usually applied by tennis racket ball batting, and elongations.

Figure 4:
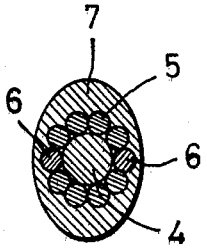
FIG. 4 is a sectional view of modified example of this invention.

FIG. 4 shows another example of this invention. Element 4 is a Nylon 6 filament No. 28 which is 0.87 mm. in diameter. Element 5 is a Nylon 6 filament No. 3 which is 0.28 mm. in diameter and element 6 is a carbon fiber multifilament prepared such that 1800 carbon fiber monofilaments, each being 5$\mu$ in diameter, are twisted together in a combination of 200 turns/m. The filament 4 is used as a core, and eight of the filaments 5 and two of the filaments 6 are disposed around the same, with each filament 6 being interposed between four filaments 5. These are twisted together in a combination of 100 turns/m. and are then coated with a nylon coating layer 7. This is the embodying example product B. This embodiment is designated as B which along with other embodiments C to J of this invention have the respective various properties as shown in Table 2 and in FIG. 5. As for the synthetic resin filament, almost the same results can be obtained by either monofilament or multifilament.

Table 2

| Embodiment | Number of carbon filaments | Other filaments | Core | Coating layer | Wire density (g/m) | Gut Diam. (mm.) | Breaking strength (kg./gut) | Tensile Modulus (kg./gut) |
|---|---|---|---|---|---|---|---|---|
| B | 2 | 8 of Nylon 6 No. 3 | 1 of Nylon 6 No. 28 | Nylon 66 | 1.4 | 1.4 | 60 | 255 |
| C | 3 | 9 of Nylon 6 No. 3 | 1 of Nylon 6 No. 30 | " | 1.4 | 1.4 | 65 | 300 |
| D | " | 7 of Nylon 6 No. 3 and 1 of SiC | " | " | " | " | 63 | 260 |
| E | 8 | 1 of SiC | Nil | " | 1.2 | 1.2 | 70 | 320 |
| F | 10 | Nil | Nil | " | 1.2 | 1.1 | 70 | 370 |
| G | 10 | Nil | Nil | Nil | 1.0 | 1.0 | 65 | 370 |
| H | 10 | Nil | Nil | Aluminum | 1.2 | 1.3 | 75 | 400 |
| I | 4 | Nil | 1 of Nylon 6 No. 30 | Nylon 66 | 1.4 | 1.4 | 70 | 280 |
| J | 1 | 1 of Nylon 6 No. 1 1 of Sic | Nil | " | 1.4 | 1.4 | 70 | 320 |

The Nylon 6 No. 30 in product C is 0.9 mm. in diameter, and the carbon filaments in the products C–H are all the same as that used in the product B. The SiC filament is composed of a multifilament prepared such that 1000 monofilaments, each being 10μ in diameter, 400 kg./mm.$^2$ in tensile strength and 30 t/mm$^2$ in Young's modulus, are twisted together. The SiC filament in each of the products D,J is twisted by 200 turns/m. and, in the product E, is twisted by 300 turns/m.

Figure 5:
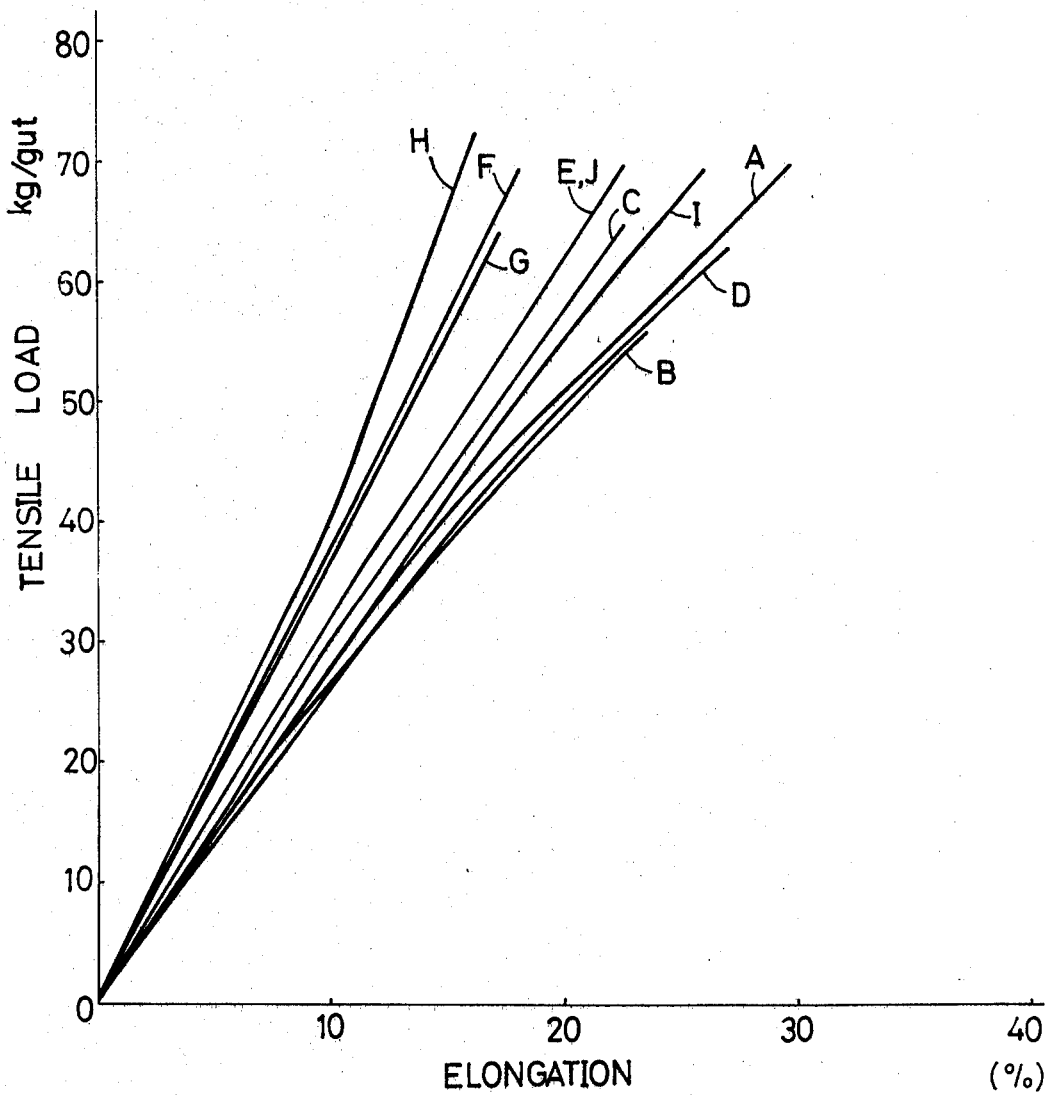
FIG. 5 is a diagram showing the relationship between tensile load and elongation with respect to the latter guts.

As will be clear from the above Table and FIG. 5, all of the embodiments of the present invention are extremely superior with respect to the various properties such as breaking strength, tensile modulus and others, to the conventional synthetic form and a gut which is larger in tensile modulus than those of the animal string guts can be obtained as occasion demands. Thus, a novel racket can be obtained. Additionally, the mode of the tensile modulus of each has generally a linear characteristic similar to that of the sheep gut and the mode of the gut composed solely of synthetic fibers is improved.

Further, it has been found that the products of the invention are stable against dryness or wetness and excellent in abrasion resistance. In addition, rackets formed with guts of this invention are excellent in ball batting characteristics. Guts of this invention have been stretched with a stringing machine in racket frames for producing tennis rackets which were tested by professional players for feel. It has been found that these rackets are excellent especially in a bouncing property which due to the gut, and the ball batting sounds thereof are pleasant metallic sounds. For this, the foregoing products A, B and C are particularly excellent.

Thus, according to this invention, a gut for a racket is composed at least partly of carbon fibers, so that various defects inherent in conventional guts of animal strings and of synthetic fibers can be avoided. At the same time, a gut having the good points possessed by conventional guts can be obtained, and a novel gut for a racket which is extremely resistent to tensile load can be provided as occasion demands. Proper adjustment thereof on being stretched in a racket frame can be easily effected in view of their mode characteristics. The raw material there of is readily available and stable products without fluctuation in characteristics can be obtained.

What is claimed is:

1. A gut for a racket comprising a combination of carbon fibers and organic fibers, and synthetic resin mixed with said carbon fibers which are in the form of chopped carbon fiber filaments.

2. A gut for a racket as claimed in claim 1, wherein the gut is composed of a combination of said carbon fibers, organic fibers and inorganic fibers.

3. A gut for a racket as claimed in claim 1, comprising aluminum, copper, tin or an alloy thereof as a coating.

4. A gut for a racket as claimed in claim 1, comprising a synthetic resin as a coating material.

5. A gut for a racket as claimed in claim 1, wherein said organic fibers and said synthetic resin are made of nylon.

6. A gut for a racket comprising a combination of carbon fibers and synthetic fibers and at least one of the two kinds of fibers is twisted to produce a combined fiber gut having a substantially linear relation between tensile modulus and elongation and wherein the modulus value ranges from about 260 Kg./gut to about 290 Kg./gut.

7. A gut for a racket as claimed in claim 6 wherein the carbon fibers are in the form of multifilaments and the synthetic fibers are in the form of mono or multifilaments, the two kinds of filaments being twisted together.

8. A gut for a racket as claimed in claim 6 wherein the carbon fibers are in the form of untwisted or twisted multifilaments and the synthetic fibers are in the form of a monofilament or untwisted or twisted multifilaments, and at least one of the synthetic fiber monofilament or multifilaments being used as a core and at least one of the carbon multifilaments is twisted around the core.

9. A gut for a racket as claimed in claim 6 wherein the carbon fibers are in the form of untwisted or twisted multifilaments and the synthetic fibers are in the form of a monofilament or untwisted or twisted multifilaments, and at least one of the synthetic fiber monofilament or multifilaments is used as a core and at least one of the carbon multifilaments are twisted around the core.

10. A gut for a racket as claimed in claim 6 wherein the carbon fibers comprise a multifilament of string or tape form.

11. A gut for a racket as claimed in claim 6 comprising the combination of said carbon fibers, said synthetic fibers and inorganic fibers, at least one of the three kinds of fibers being twisted so that a combined fiber gut has a nearly linear relation between tensile modulus and elongation and has a modulus value ranging from about 260 Kg./gut to about 290 Kg./gut.

12. A gut for a racket as claimed in claim 7 wherein the combined and twisted fibers also comprises a synthetic resin as a coating.

13. A gut for a racket as claimed in claim 8 wherein the combined and twisted fibers also comprises a synthetic resin as a coating.

14. A gut for a racket as claimed in claim 9 wherein the combined and twisted fibers also comprises a synthetic resin as a coating.

15. A gut for a racket as claimed in claim 10 wherein the combined and twisted fibers also comprises a synthetic resin as a coating.

16. A gut for a racket as claimed in claim 7 wherein the combined and twisted fibers also comprises a metal as a coating.

17. A gut for a racket as claimed in claim 8 wherein the combined and twisted fibers also comprises a metal as a coating.

18. A gut for a racket as claimed in claim 9 wherein the combined and twisted fibers also comprises a metal as a coating.

19. A gut for a racket as claimed in claim 10 wherein the combined and twisted fibers also comprises a metal as a coating.

20. A gut for a racket as claimed in claim 6, wherein said synthetic fibers are made of nylon.

* * * * *